US007934376B2

(12) United States Patent
Biester

(10) Patent No.: US 7,934,376 B2
(45) Date of Patent: May 3, 2011

(54) HYDRAULIC ACTUATION ASSEMBLY

(75) Inventor: Klaus Biester, Wienhausen (DE)

(73) Assignee: Cameron International Corporation, Houston, TX (US)

( * ) Notice: Subject to any disclaimer, the term of this patent is extended or adjusted under 35 U.S.C. 154(b) by 646 days.

(21) Appl. No.: 11/912,570

(22) PCT Filed: Apr. 27, 2006

(86) PCT No.: PCT/US2006/016130

§ 371 (c)(1),
(2), (4) Date: Nov. 16, 2007

(87) PCT Pub. No.: WO2006/116647

PCT Pub. Date: Nov. 2, 2006

(65) Prior Publication Data

US 2008/0202109 A1 Aug. 28, 2008

(30) Foreign Application Priority Data

Apr. 27, 2005 (DE) ..... 20 2005 006 719 U

(51) Int. Cl.
*F16D 31/02* (2006.01)
*E21B 34/04* (2006.01)

(52) U.S. Cl. ..... 60/405; 166/351

(58) Field of Classification Search ..... 60/405; 166/351
See application file for complete search history.

(56) References Cited

U.S. PATENT DOCUMENTS

| | | | | |
|---|---|---|---|---|
| 4,276,003 | A | 6/1981 | Perkins et al. | |
| 5,301,505 | A | 4/1994 | Wright | |
| 5,358,035 | A | 10/1994 | Grudzinski | |
| 6,568,476 | B1 * | 5/2003 | Andersen | 166/363 |

FOREIGN PATENT DOCUMENTS

| | | |
|---|---|---|
| EP | 0433649 | 6/1991 |
| WO | 95/08860 | 3/1995 |
| WO | 01/65061 | 9/2001 |
| WO | 2005/1015019 | 2/2005 |

* cited by examiner

*Primary Examiner* — F. Daniel Lopez
(74) *Attorney, Agent, or Firm* — Conley Rose, P.C.

(57) ABSTRACT

An assembly for the hydraulic actuation of safety equipment includes a hydraulic pump disposed between a fluid feed line and a supply line in fluid communication with the safety equipment. A pump valve in the supply line downstream of the hydraulic pump is adjustable between open and closed positions for providing hydraulic fluid to supply line. A fluid source communicates with a bypass line in fluid communication with the supply line. A bypass valve is disposed between the fluid source and the supply line and is lockable between open and closed positions for providing other hydraulic fluid to supply line.

21 Claims, 2 Drawing Sheets

HYDRAULIC ACTUATION ASSEMBLY

CROSS-REFERENCE TO RELATED APPLICATION

The present application is a National Phase entry of PCT Application No. PCT/US2006/016130 filed 27 Apr. 2006, which claims priority to German Utility Model Application 20 2005 006 719.9, filed 27 Apr. 2005, both of which are hereby incorporated herein by reference. Related to the present application are U.S. patent application Ser. No. 10/564,584 filed 1.3 Jan. 2006, PCT/EP2004/007948 filed 16 Jul. 2004, and German Application No. 203 11 033.1 filed 17 July 2003, all hereby incorporated herein by reference.

STATEMENT REGARDING FEDERALLY SPONSORED RESEARCH OR DEVELOPMENT

Not Applicable.

BACKGROUND OF THE INVENTION

The invention relates to an assembly for the hydraulic actuation of equipment for particular use in hydrocarbon extraction, such as crude oil or natural gas extraction. Such equipment may be, for example, a safety valve in fluid communication with a riser or a Christmas tree used in hydrocarbon extraction from subsea wells. The assembly comprises a pump device that includes a piston/cylinder unit and an electrical drive device which is movably connected to a piston of the piston/cylinder unit for intermittent pump movement. The pump device is disposed between a fluid feed line and a supply line communicating with the equipment.

Such a pump device is known from DE 20.3 11 03.3 and PCT/EP2004/007948, hereby incorporated herein by reference. A pump device as such comprises a screw drive, a reduction gear unit, a spurwheel gear unit and at least one drive shaft with at least one electric motor driving the drive shaft. The screw drive comprises a rotatable, but axially immovable spindle nut, and an axially movable threaded spindle which is connected at an actuating end to the piston of the piston/cylinder unit. The appropriate reduction gear unit can, for example, be a so-called harmonic drive gear unit.

The piston is movably supported in a piston cavity of a cylinder of the piston/cylinder unit, wherein the piston cavity includes at least one suction hole and one discharge hole; and non-return or check valves subject to force can be arranged in each of these holes in different directions.

A discharge hole or a discharge line, which leads to a pressure switch, can branch from the supply line. This can actuate a safety valve. An electrical servomotor can be provided to actuate the safety valve.

Reference is made to DE 203 11 033 for the further description of the pump device.

It may be desirable on site, which also means below the surface of the sea, to bypass the pump device in a simple manner in an emergency in order to be able to continue to feed hydraulic fluid with an adequate pressure to the appropriate equipment, such as a subsea safety valve.

SUMMARY OF THE PREFERRED EMBODIMENTS

In order to bypass the pump device, an exemplary embodiment of the assembly includes, in the supply line leading from the pump device to the appropriate unit downstream and following a pump valve that is adjustable between the closed and open positions, a bypass pipe connected to the fluid feed line and opening into the supply line and in which a bypass valve that is adjustable between open and closed positions is arranged.

If the pump device is no longer suitable with its normal operation for supplying an adequate pressure for the actuation of the respective equipment, the pump valve closes and the bypass valve opens so that hydraulic fluid under appropriate pressure is passed directly from the fluid feed line to the respective equipment, such as the safety valve. For this purpose it may be necessary to increase the fluid pressure within the fluid feed line. In this way, in the event of a failure of the pump device, the equipment, such as the safety valve, may still be actuated properly.

Various hydraulic fluids can be used by the pump device. Preferably, hydraulic fluids already present locally are used. The use of an inhibitor may be of advantage. Such an inhibitor is added to the crude oil to be transported in order to optionally liquefy solid constituent parts of the crude oil, such as paraffin or similar substances, and to prevent blockage by these constituent parts during the transport of the oil. Such an inhibitor is sufficiently present in the region of a tree in the vicinity of the wellbore, so that no supply problems arise locally. At the same time, a leak of the crude oil being transported is relatively uncritical, because the inhibitor is in any case already added to the crude oil for its transport.

Since only slight quantities of the inhibitor and/or other hydraulic fluid are needed for the pump device, the fluid feed line can branch from a feed line for the inhibitor or for the other hydraulic fluid.

With the failure of all equipment, irrespective of whether it is electrical, hydraulic or pneumatic, in order to be able to ensure that the safety equipment is capable of operation, it can be advantageous if the pump and bypass valves are accessible for actuation by a remotely controlled vehicle via an access device for the vehicle for adjustment between the open and closed positions. Such a remotely controlled vehicle is designated as an ROV (Remote Operated Vehicle) and is normally not manned. Under remote control, it can travel to the access device and adjust the pump or bypass valve using appropriate manipulators.

In order to also provide sufficient hydraulic pressure for the safety valve or another device using the remotely controlled vehicle, the access device can comprise a hydraulic connection for the feed of hydraulic fluid directly from the remotely controlled vehicle.

In this way there is a total of three ways of feeding sufficient hydraulic fluid to the safety equipment from three alternative sources for supplying hydraulic fluid under pressure. In the normal case the feed of the hydraulic fluid and the maintenance of an appropriate pressure occurs by the pumping of the pump device. This is always actuated when the pressure on the safety equipment reduces and, for example, falls below a specified set value. If pumping is not possible because, for example, the electrical supply has been interrupted, a switchover to the bypass can take place using the remotely controlled vehicle. Then the pressure is supplied directly from the surface via, for example, the inhibitor feed line. When doing this, it may be necessary to increase the pressure in the feed line in order to provide the pressure required for the safety equipment.

If this possibility is also not available, because for example a leak is present in the feed line, and sufficient pressure cannot be made available at the surface or a similar reason, there is still the possibility of providing hydraulic fluid and, therefore, pressure from the remotely controlled vehicle via the access device with the appropriate hydraulic connection. For this purpose the remotely controlled vehicle couples to the hydraulic connection and pumps hydraulic fluid until a sufficient pressure is obtained. The vehicle can then be switched into an idle state in that, for example, a non-return valve within the vehicle prevents the pressure from falling. The vehicle then remains on site and optionally feeds hydraulic fluid again until one of the two other possibilities becomes available.

The pump device can be part of a tree or at least can be arranged also on the sea bed in the vicinity of a tree. In order to be able to feed the hydraulic fluid to the safety equipment from the pump device in a simple manner, the supply line can in particular feed into a hydraulic line arranged directly in the riser or the transport system, which then leads within the riser or the system to the safety equipment, such as a safety valve or a wellbore safety valve or similar device. One example of such safety equipment is a so-called downhole safety valve (DHSV).

The access device itself can also be disposed directly on the tree or also on the pump device directly as an access panel. The panel includes appropriate equipment to facilitate the coupling of the remotely controlled vehicle to its corresponding manipulators in order for example to adjust the valves or to couple to the hydraulic connection. The access panel can also be formed as a device, which is separate from the pump device and is independent.

There is of course also the possibility that the adjustment of the valves occurs not by such a remotely controlled vehicle, but rather manually by a diver or similar person.

With the pump device, it should be noted that it is not normally in permanent operation, but is rather actuated intermittently by remote control to maintain a specified hydraulic pressure. This means that the pump device is operated in order, for example in the case of a downhole safety valve, to increase the hydraulic pressure so far that it is open against the pressure of the crude oil to be transported and is only closed in an emergency. Thereafter, the pump device can be switched into a standby state.

In order to be able to feed hydraulic fluid and thus maintain sufficient hydraulic pressure for a certain time without actuating the pump device, or optionally if a leak has developed, a pressure accumulator can be in fluid communication with the pump device. Hydraulic fluid is transported in the direction of the downhole safety valve through the pressure accumulator at least for a sufficient time so that pumping by the pump device only takes place again when the pressure in the pressure accumulator has fallen to a specified set value.

It may be convenient if at least parts of the drive device are constructed redundantly and the pump device is overall of modular construction. Indeed, the foregoing summary merely provides exemplary embodiments of the present invention and is not intended to limit the scope of the appended claims to what is summarized.

BRIEF DESCRIPTION OF THE DRAWINGS

In the following, an advantageous embodiment of the invention is explained in more detail based on the following Figures.

DETAILED DESCRIPTION OF THE PREFERRED EMBODIMENTS

Figure 1:
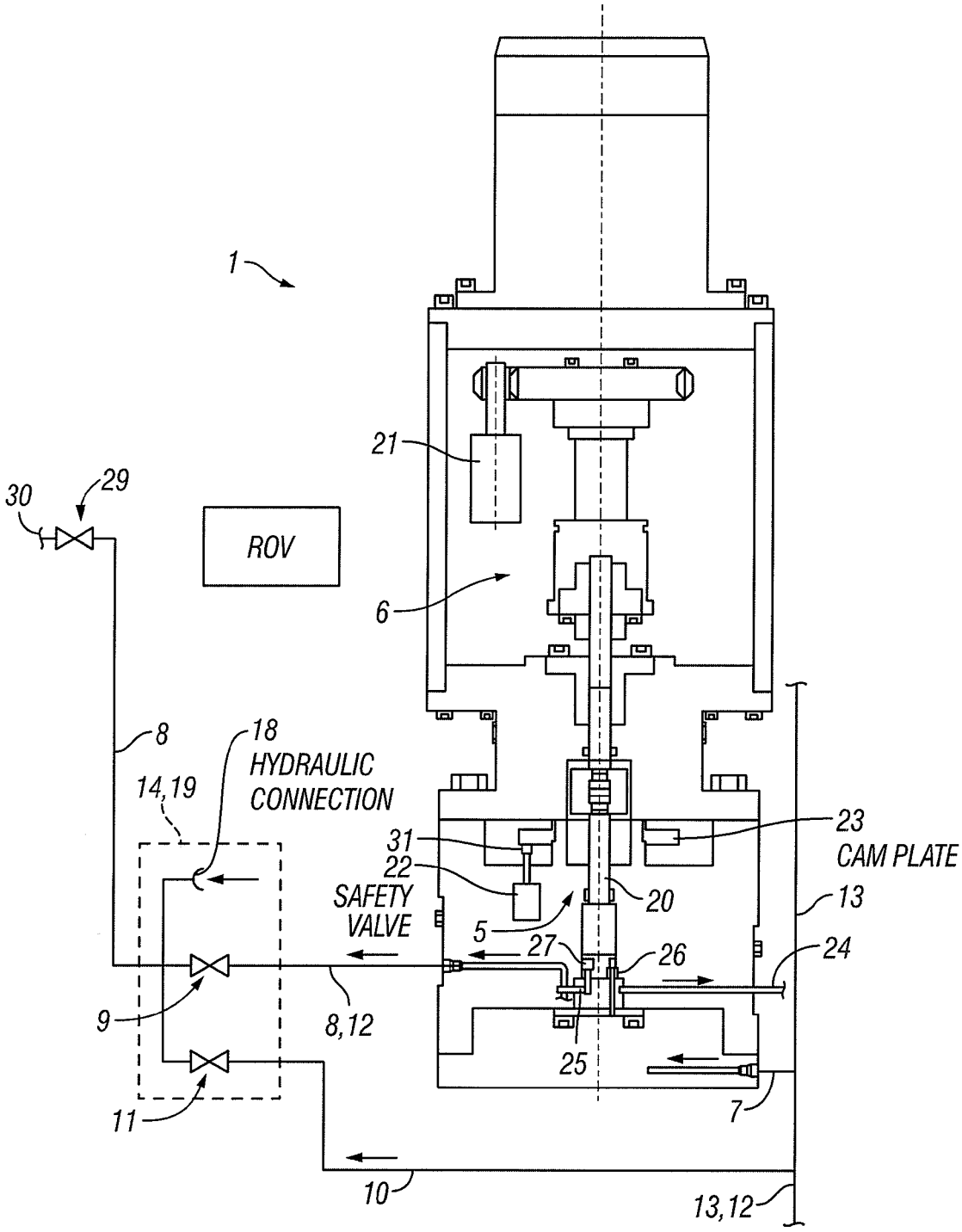
FIG. 1 is a longitudinal section of a schematic diagram of a pump device according to the invention with the access device.

FIG. 1 shows a longitudinal section of a pump device 1 illustrated schematically in accordance with one embodiment of the present invention. The pump device, as is illustrated, is described in detail in DE 203 11 033. The pump device 1 comprises a drive device 6 with an electrical motor 21, via which a threaded spindle device is driven, such that a piston 20 of a piston/cylinder unit 5 can be moved to and fro in the longitudinal direction of the pump device. This movement causes pumping of a hydraulic fluid. The fluid is pumped via a fluid feed line 7 and a non-return or check valve 26 into the cylinder cavity 61 of the piston/cylinder unit 5. Subsequently, fluid is pumped to a non-return or check valve 27 configured in the reverse direction and an annular pipe 25 that on one hand provides fluid to supply line 8 and on the other hand to the pressure accumulator line 24. The pressure accumulator line 24 extends to a pressure accumulator, which is not illustrated in FIG. 1, and details of this pressure accumulator can be, in this respect, found in DE 203 11 033.

The fluid feed line 7 opens into an inhibitor feed line 13, which in FIG. 1 is only shown in section and which extends for example from the surface of the sea to the subsea wellhead or wellbore and the corresponding Christmas tree. The inhibitor is transported in the inhibitor feed line 13 as hydraulic fluid 12 with a certain pressure.

A bypass line 10, via which the inhibitor is fed as a hydraulic fluid directly to an access device 14, thus bypassing the actual pump of the pump device 1, is in fluid communication with the inhibitor feed line 13.

The supply line 8 feeds to the access device 14. Both lines, i.e., the supply line 8 and bypass line 10, are in fluid communication with the access device 14, via the pump valve 9 or, respectively, the bypass valve 11. The access device 14 can adjust the valves 9, 11 between their open and closed positions.

Furthermore, the access device 14 includes a hydraulic connection 18, also designated an ROV hot step, to which a remotely controlled vehicle can be coupled to feed hydraulic fluid from the vehicle directly via the hydraulic connection 18 to the supply line 8 leading from the access device 14.

Figure 2:
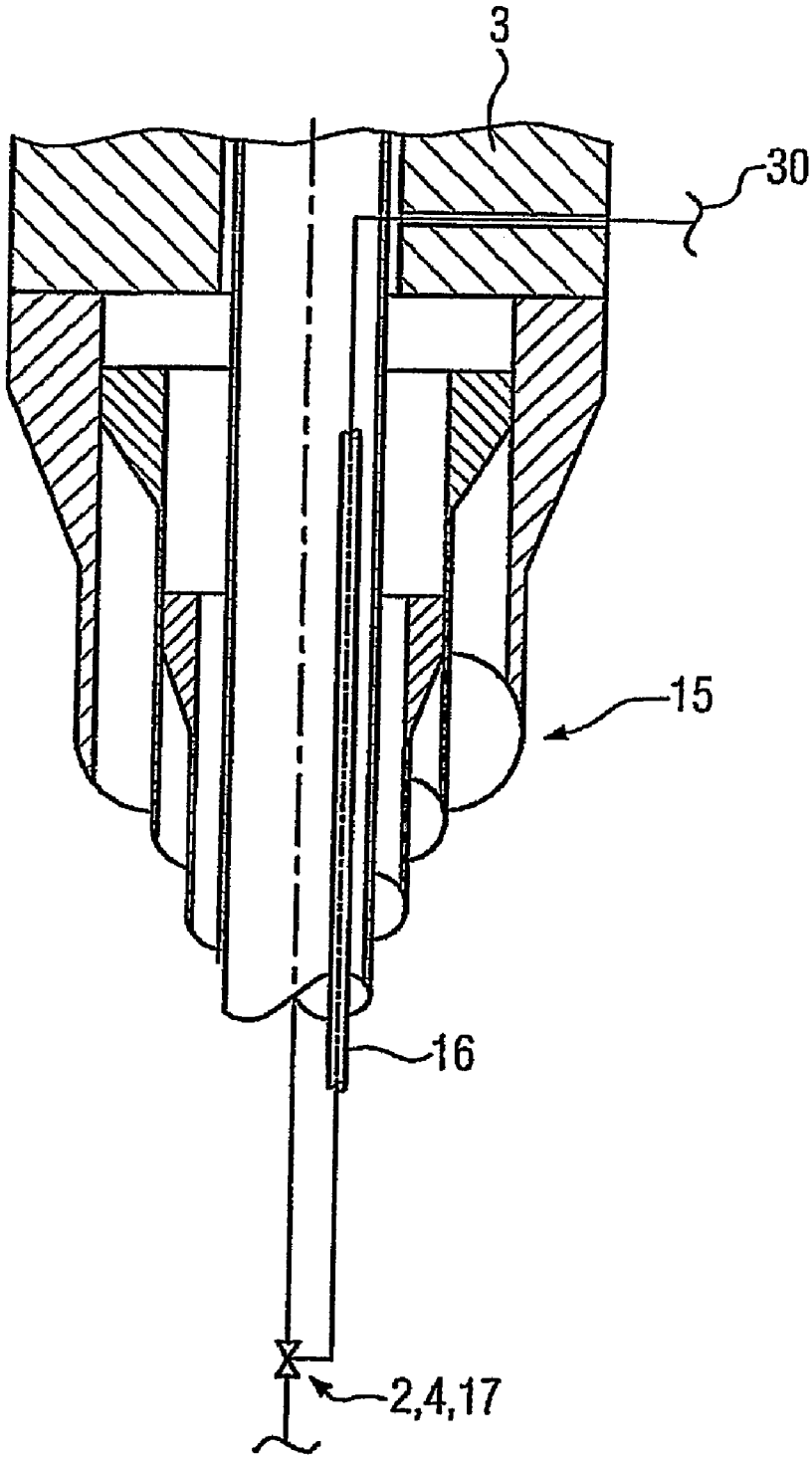
FIG. 2 is a longitudinal section through a riser in the region of a tree or well head.

Through the access device 14, which can be disposed in the access panel 19 directly on the pump device 1 or also arranged remotely to it, there are various ways of providing sufficient hydraulic fluid for safety equipment such as shown in FIG. 2.

With the first possibility, the feed of hydraulic fluid occurs from the piston/cylinder unit 5 by appropriate pumping or from the corresponding pressure accumulator, which is omitted in FIG. 1 for simplification. If a fault occurs in the actual pump, there is the second possibility of using the bypass line 10. When employing the bypass line 10, the corresponding bypass valve 11 is opened and the pump valve 9 is closed. This actuation of valves can occur through the already mentioned remotely controlled vehicle, which is normally an ROV (Remote Operated Vehicle). With the second possibility, the direct feed of the inhibitor occurs via the bypass line 10 from the inhibitor feed line 13 Optionally, on the inlet to the inhibitor feed line, which can be arranged at the sea surface, the pressure in the line is increased to provide sufficient pressure for the safety equipment 2 shown in FIG. 2.

As the third possibility, if the two first possibilities are not fruitful or not desired, appropriate hydraulic fluid can be fed via the hydraulic connection 18 directly from the remotely controlled vehicle. This can similarly be inhibitor or also another hydraulic fluid. To achieve this, the remotely controlled vehicle is equipped with an appropriate pump device with which a non-return or check valve is also optionally in fluid communication. The vehicle remains coupled to the hydraulic connection 18 until one of the two other possibilities becomes possible again or is selected, for instance. Due to the non-return valve in the vehicle, it is not necessary that its pump be continually in operation.

The pump device 1 also comprises a safety valve 22, which is actuated via a rotatable cam plate 23 with a protruding cam 31. This valve 22 comes into operation when a pressure, such as in the pressure accumulator line 24 or supply line 8 becomes too high, wherein these can be practically short-circuited with the fluid feed line 7.

FIG. 2 illustrates a longitudinal section through a transport head system 15 with the riser 3. This transport system 15 is part of a tree and at the connecting point 30 a connection is made from it to the supply line 8 shown in FIG. 1. Here, a tree valve 29 is also in fluid communication with the connecting point or also directly to the transport system 15.

The supply line 8 opens within the riser 3 to a hydraulic line 16, which extends along the riser 3 to the safety equipment 2, which for example is a safety valve 17 and in particular a so-called wellbore safety valve (downhole safety valve). This optionally closes the riser 3 if the pressure fed externally drops below a predetermined value.

The transport system 15 consists of a series of coaxially arranged pipes, wherein the appropriate crude material, such as crude oil or natural gas is transported in the interior of the riser 3.

While a preferred embodiment of the invention has been shown and described, modifications thereof can be made by one skilled in the art without departing from the spirit of the invention.

What is claimed is:

1. A pump device used in oil and gas wells for the hydraulic actuation of equipment, comprising:

a piston/cylinder unit and an electrical drive device, movably connected to the piston of the piston/cylinder unit for at least intermittent pump movement, wherein the pump device is capable of pumping fluid from a fluid feed line to the equipment through a supply line;

a pump valve located in the supply line and capable of controlling fluid flow from the pump to the equipment, wherein the pump valve is selectively lockable in an open position;

a bypass line connecting the fluid feed line upstream of the pump device to the supply line downstream of the pump device and the pump valve;

a bypass valve capable of controlling fluid flow from the feed line, through the bypass line, and to the equipment;

wherein the bypass valve is selectively lockable in an open position such that fluid is able to be communicated from the fluid feed line to the equipment through the bypass line;

wherein the pump and bypass valves are accessible for actuation by a remotely controlled vehicle via an access device for the vehicle for adjustment between the open and closed positions; and wherein the access device comprises a hydraulic connection or the feed of hydraulic fluid from the remotely controlled vehicle.

2. The pump device according to claim 1, wherein the hydraulic fluid is an inhibitor.

3. The pump device according to claim 1, wherein the fluid feed line is branched from an inhibitor feed line.

4. The pump device according to claim 1, wherein the supply line opens into a hydraulic line disposed in a riser of a well, which leads to a wellbore safety valve.

5. The pump device according to claim 1, wherein the access device is arranged on a tree or comprises an access panel arranged on the pump device directly.

6. The pump device according to claim 1, wherein the pump device is actuatable intermittently by remote control for maintaining a certain hydraulic pressure.

7. The pump device according to claim 1, wherein the pump device is in fluid communication with a pressure accumulator.

8. The pump device according to claim 1, wherein the pump device is constructed redundantly at least with regard to its drive device.

9. The pump device according to claim 1, further comprising a rotatable cam plate with at least one axially protruding cam for the actuation of a safety valve.

10. An assembly for the hydraulic actuation of safety equipment, comprising:

a hydraulic pump disposed between a fluid feed line and a supply line, such that the pump is able to pump fluid to the safety equipment through the supply line;

a pump valve in the supply line downstream of the hydraulic pump and adjustable between open and closed positions for controlling hydraulic fluid flow through the supply line to the safety equipment;

a fluid source communicating with a bypass line connecting the fluid feed line upstream of the pump with the supply line downstream of the pump;

a bypass valve disposed in the bypass line and lockable between open and closed positions for controlling flow of other hydraulic fluid through the bypass line to the safety equipment through the supply line;

wherein the pump and bypass valves are accessible for actuation by a remotely controlled vehicle via an access device for the vehicle for adjustment between the open and closed positions; and wherein the access device comprises a hydraulic connection or the feed of hydraulic fluid from the remotely controlled vehicle.

11. The assembly according to claim 10 further including a second fluid source communicating in fluid communication with the supply line; and an access connection disposed between the second fluid source and the supply line for providing additional hydraulic fluid to supply line.

12. A hydraulic actuation assembly for the hydraulic actuation of subsea equipment, including:

a subsea operable pump device arranged subsea between a fluid feed line and a supply line, the pump device output communicating with the supply line;

a bypass line;

an access device connected to the supply line downstream of the pump device, the access device including a pump valve and a bypass valve located downstream of the pump valve that is connectable with the bypass line;

the supply line downstream of the access device communicating with the subsea equipment, and flow though the access device to the subsea equipment being selectable between flow from the pump device or from the bypass line by adjustment of the pump valve and bypass valve; and wherein the access device includes a hydraulic connection for the feed of hydraulic fluid from a remotely controlled vehicle to the supply line downstream of the pump valve.

13. The pump device of claim 12, wherein the hydraulic fluid is an inhibitor.

14. The pump device of claim 12, wherein the fluid feed line and the bypass line are branched from an inhibitor feed line upstream of the pump device.

15. The pump device of claim 12, wherein the pump and bypass valves are accessible for actuation by a remotely controlled vehicle via the access device for adjustment between the open and closed positions.

16. The pump device of claim 12, wherein the pump device is actuatable intermittently by remote control for maintaining a certain hydraulic pressure.

17. A method of hydraulically actuating subsea equipment, including:

arranging a subsea operable pump device subsea between a fluid feed line and a supply line, the pump device output communicating with the supply line;

connecting an access device to the supply line downstream of the pump device, the access device including a pump valve and a bypass valve located downstream of the pump valve;

connecting a bypass line to the bypass valve;

selecting flow through the access device to the subsea equipment to be from the pump device or from the bypass line by adjusting the pump valve and the bypass valve;

flowing fluid from the access device downstream to hydraulically actuate the subsea equipment;

connecting a remotely controlled vehicle to a hydraulic connection of the access device; and feeding hydraulic fluid from the remotely controlled vehicle to the supply line downstream of the pump valve.

18. The method of claim 17, wherein the hydraulic fluid is an inhibitor.

19. The method of claim 17, wherein the fluid feed line and the bypass line are branched from an inhibitor feed line upstream of the pump device.

20. The method of claim 17, further including adjusting the pump and bypass valves using a remotely controlled vehicle via the access device between the open and closed positions.

21. The method of claim 17, further including intermittently actuating the pump device by remote control for maintaining a certain hydraulic pressure.

* * * * *